US008416159B2

(12) United States Patent
Yamashita

(10) Patent No.: US 8,416,159 B2
(45) Date of Patent: Apr. 9, 2013

(54) DISPLAY APPARATUS

(75) Inventor: Keitaro Yamashita, Hyogo (JP)

(73) Assignee: Chimei Innolux Corporation, Zhunan Township, Miaoli County (TW)

( * ) Notice: Subject to any disclaimer, the term of this patent is extended or adjusted under 35 U.S.C. 154(b) by 271 days.

(21) Appl. No.: 12/841,715

(22) Filed: Jul. 22, 2010

(65) Prior Publication Data

US 2012/0019436 A1 Jan. 26, 2012

(51) Int. Cl.
*G09G 3/36* (2006.01)
*G09G 3/20* (2006.01)
*G09G 3/30* (2006.01)

(52) U.S. Cl.
USPC ..... 345/76; 345/90; 345/55

(58) Field of Classification Search ..... 345/76
See application file for complete search history.

(56) References Cited

U.S. PATENT DOCUMENTS

| | | | | |
|---|---|---|---|---|
| 6,115,017 | A * | 9/2000 | Mikami et al. | 345/92 |
| 6,563,480 | B1 * | 5/2003 | Nakamura | 345/82 |
| 2002/0122330 | A1 * | 9/2002 | Houston | 365/154 |
| 2002/0159312 | A1 * | 10/2002 | Kasai et al. | 365/200 |
| 2003/0006977 | A1 * | 1/2003 | Hanari et al. | 345/204 |
| 2008/0238855 | A1 * | 10/2008 | Teranishi et al. | 345/98 |

FOREIGN PATENT DOCUMENTS

| | | |
|---|---|---|
| CN | 1357870 | 7/2002 |
| TW | 548625 | 8/2003 |

* cited by examiner

*Primary Examiner* — Alexander S Beck
*Assistant Examiner* — Mihir Rayan
(74) *Attorney, Agent, or Firm* — Muncy, Geissler, Olds & Lowe, PLLC

(57) ABSTRACT

A display apparatus includes a plurality of pixels. Each pixel has a light emitting unit, a memory cell, and a driving circuit. The memory cell stores an image data. The driving circuit is electrically connected with the light emitting unit and the memory cell, and drives the light emitting unit according to the image data.

5 Claims, 7 Drawing Sheets

DISPLAY APPARATUS

This application claims the benefit of U.S. Provisional Patent Application No. 61/233,862 entitled Circuit for memory and use of the same in active matrix devices, inventor Keitaro Yamashita, filed Aug. 14, 2009, and incorporated herein by reference.

BACKGROUND OF THE INVENTION

1. Field of Invention

The invention relates to a display apparatus and, in particular, to an organic light-emitting diode (OLED) display apparatus.

2. Related Art

Recently, the OLED with various advantages, such as high brightness, full color, wide viewing angle, self-emission, fast response speed, flexibility, simple manufacturing process, low cost, etc., is developed. Compared with the liquid crystal display technology, the OLED display apparatus is a better choice with considering the property requirements of flat display apparatuses.

FIG. 1 is a schematic diagram showing the pixel circuit 10 in a conventional OLED display apparatus. As shown in FIG. 1, the pixel circuit 10 comprises a scan line S and a data line D crossed in the form of a matrix, an n-type thin-film transistor 11, a p-type thin-film transistor 12, a capacitor 13, and an OLED 14. The gate of the n-type thin-film transistor 11 is connected with the scan line S, the drain thereof is connected with the data line D, and the source thereof is connected with the p-type thin-film transistor 12 and the capacitor 13. Accordingly, within a frame time, when the scan line S outputs a scan signal to turn on the n-type thin-film transistor 11, the image data is inputted to the capacitor 13 through the data line D and the n-type thin-film transistor 11. At this moment, the p-type thin-film transistor 12 is turned off. After that, the n-type thin-film transistor 11 is then turned off, so that the p-type thin-film transistor 12 can be turned on according to the image data stored in the capacitor 13. Consequently, the power source Vdd can be inputted to drive the OLED 14 to emit light.

The memory 15 stores pixel data which should be written into pixel circuit 10. The gate driver 16 control the pixel circuit 10 to receive image data from the source driver 17, and thus the source driver 17 writes the image data stored in the memory 15 into the pixel circuit 10.

Regarding to the resolution of QVGA, there are totally 320 pixels connected with the data line D, and the analog voltage corresponding to the image data is transmitted to the pixels in order through the data line D. Before next frame time, each pixel must maintain its brightness corresponding to the inputted analog voltage level. Since the brightness of each pixel is a function of the gate voltage of the p-type thin film transistor 12, the gate voltage of the p-type thin film transistor 12 should be remained for the period of a frame time (about 16.6 msec) by the capacitor 13.

However, the leakage current issue may occur in both the n-type thin-film transistor 11 and the p-type thin-film transistor 12, which will consume the electricity stored in the capacitor 13. Thus, the voltage level of the image data stored in the capacitor 13 may be changed. After a long period (e.g. longer than a frame time), the gate voltage of the p-type thin film transistor 12 is not guaranteed. This also leads to that the p-type thin-film transistor 12 can not be turned on or off according to the correct image data during a frame time unless new image data is provided. Nevertheless, the power consumption of the display apparatus is increased.

SUMMARY OF THE INVENTION

In view of the foregoing subject, an object of the present invention is to provide a display apparatus with lower power consumption.

To achieve the above-mentioned object, the present invention discloses a display apparatus including a plurality of pixels. Each of the pixels has a light emitting unit, a memory circuit, and a driving circuit. The memory circuit stores an image data. The driving circuit is electrically connected with the light emitting unit and the memory circuit, and drives the light emitting unit according to the image data.

As mentioned above, in the display apparatus of the present invention, each pixel has a memory circuit for storing the image data during a frame time. Accordingly, the image data can be remained in the memory circuit of the pixel without continuously receiving the image data from the data line. Therefore, the memory of the source driver is unnecessary to continuously store the pixel data and output it to the corresponding pixel, so that it is not needed to apply additional power to the source driver in this circumstance. Thus, the power consumption can be reduced. To be noted, the benefit of this driving method is maximized especially at the partial dimmed lit mode.

Moreover, the display apparatus of the present invention further includes a mode switching circuit for switching the control mode between a normal mode and a Memory-In-Pixel (MIP) mode. Accordingly, the display apparatus of the present invention can be driven based on the above-mentioned driving method with lower power consumption or the conventional driving method, so that the applications of the invention can be further broadened.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

The present invention will be apparent from the following detailed description, which proceeds with reference to the accompanying drawings, wherein the same references relate to the same elements.

Figure 2:
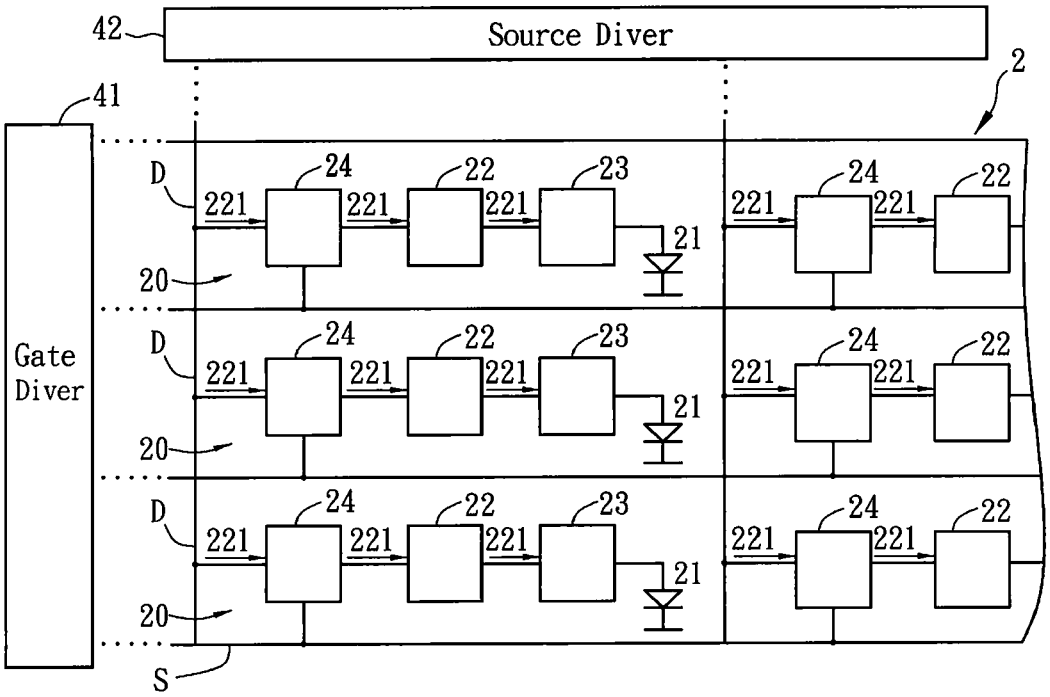
FIG. 2 is a block diagram showing the circuit of a display apparatus according to an embodiment of the present invention.

FIG. 2 is a block diagram showing the circuit of a display apparatus according to an embodiment of the present invention. With reference to FIG. 2, a display apparatus 2 includes a plurality of pixels 20, and each pixel 20 includes a light emitting unit 21, a memory circuit 22, and a driving circuit 23.

The memory circuit 22 can store an image data 221, and the driving circuit 23 is electrically connected with the light emitting unit 21 and the memory circuit 22 for driving the light emitting unit 21 according to the image data 221.

The pixels 20 are arranged in matrix, and every three pixels 20, for example, can construct a pixel unit. To be noted, the pixels 20 may also be arranged in a polygonal shape or other shape, and the pixel unit may be constructed by different numbers of pixels 20. The pixels 20 may be arranged, for example but not limited to, in stripe or in mosaic.

The light emitting unit 21 is, for example, an organic light-emitting diode (OLED). In this case, the display apparatus 2 is an OLED display apparatus. For instance, the OLED can be, for example but not limited to, a red light OLED, a green light OLED, a blue light OLED, a yellow light OLED or a white light OLED. Namely, the display apparatus includes an organic electroluminescence device.

Figure 3A:
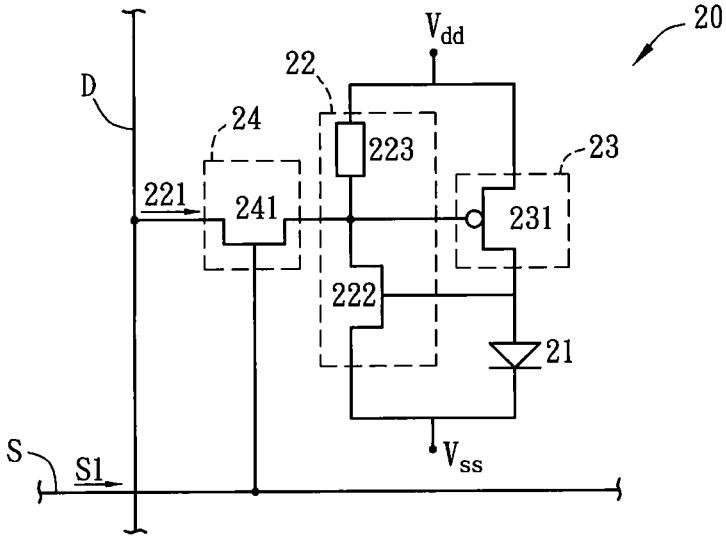
FIGS. 3A, and 3B are schematic diagrams showing the circuit of each pixel in the display apparatus according to the embodiment of the present invention.
Figure 3B:
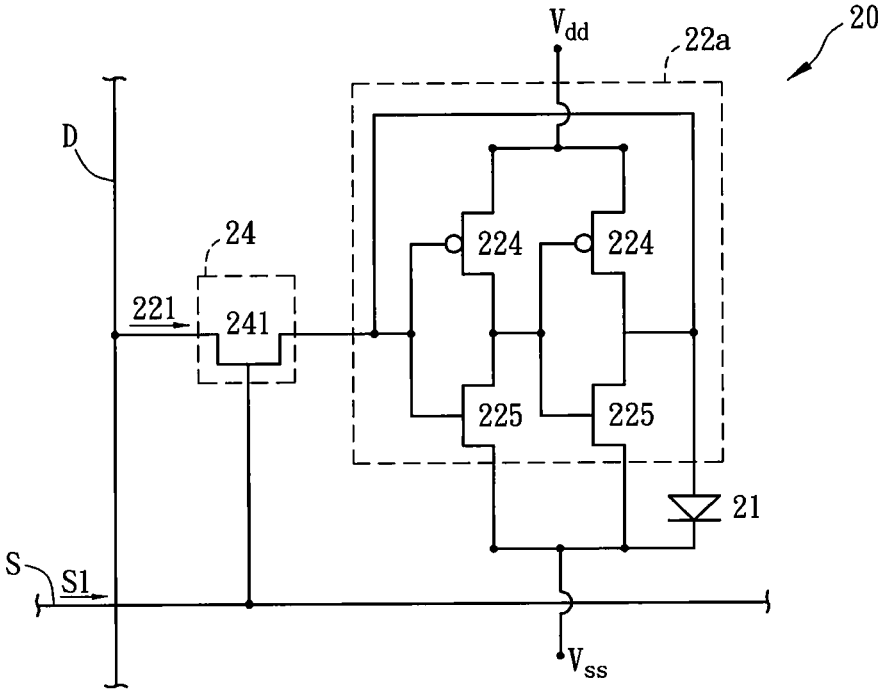

The memory circuit 22 can be implemented with SRAM-like structures shown in FIG. 3A or FIG. 3B to latch the logic state of the memory circuit 22. The memory circuit 22 behaves like static random access memory (SRAM). Referring to FIG. 3A for example, the memory circuit 22 has a transistor 222 and impendence 223, and the transistor 222 and the impendence 223 can latch the logic state of the memory circuit 22 when the switch circuit 24 is turned off. Referring to FIG. 3B, the memory circuit 22*a* has two inverters to latch the logic state of the memory circuit 22 when the switch circuit 24 is turned off, and each inverter has two transistors 224 and 225. The detail of FIGS. 3A and 3B will be described hereinafter.

Please refer to FIGS. 2 and 3A, the driving circuit 23 includes a transistor 231 such as a p-type thin film transistor or an n-type thin film transistor.

In this embodiment, each pixel 20 may further include a switch circuit 24 electrically connected with the memory circuit 22. In addition, the switch circuit 24 is further electrically connected with one of the scan lines S and one of the data lines D.

The display apparatus 2 may further include a plurality of scan lines S and a plurality of data lines D, which are electrically connected with the pixels 20, respectively. A gate driver 41 is configured to control the time sequence for writing data into the pixels 20 through the scan lines S, and a source driver 42 is configured to write image data 221 into the pixels 20 through the data lines D.

The switch circuit 24 controls the data writing of the memory circuit 22 periodically. For example, when the switch circuit 24 is turned on according to the control of the gate driver 41, the source driver 42 can write the image data 221 into the memory circuit 22 through the data line D.

The operation of pixel of this embodiment will be described hereinafter with reference FIG. 3A. FIG. 3A is a schematic diagram showing the circuit of each pixel in the display apparatus 2 as shown in FIG. 2. In this case, the light emitting unit 21 can be an OLED, so that the display apparatus 2 is an OLED display apparatus. To be noted, in order to make the following description more comprehensive, FIG. 3A shows only one pixel, and this is not to limit the scope of the present invention. In addition, the memory circuit 22 includes, for example but not limited to, a transistor 222 (e.g. an n-type thin film transistor) and an impedance 223.

Accordingly, during a frame time, when a scan signal S1 is outputted through the scan line S to turn on the transistor 241 of the switch circuit 24, the image data 221 is transmitted to and stored in the memory circuit 22 through the data line D and the transistor 241. Consequently, the image data 221 stored in the memory circuit 22 can control the on-off state of the transistor 231 of the driving circuit 23 so as to control the current applied from power source Vdd to the light emitting unit 21. Accordingly, the brightness of the light emitting unit 21 can be controlled.

Figure 1:
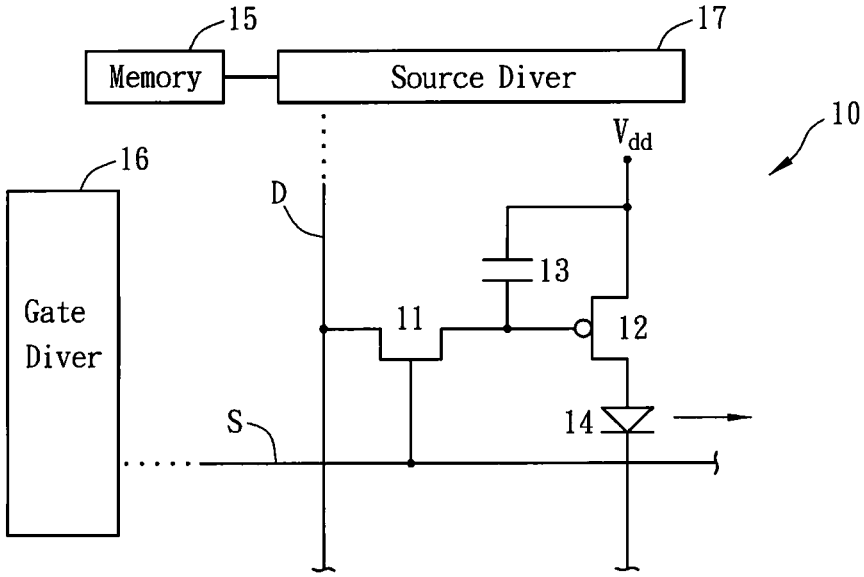
FIG. 1 (PRIOR ART)
FIG. 1 is a schematic diagram showing the pixel circuit of the conventional OLED display apparatus.

In the conventional OLED display apparatus as shown in FIG. 1, the source driver 17 must be configured with a memory 15 to store image data so as to periodically output the image data to the pixels through the data lines. Compared with the conventional OLED display apparatus, each pixel 20 of the present embodiment includes the memory circuit 22, so that it is needed to only refresh the memory circuit 22 without continuously receiving the image data 221 through the data line D. In other words, the refresh mechanism of the memory circuit 22 can remain the image data in the memory circuit 22. Therefore, the memory of the source driver is unnecessary to continuously store the image data and output it to the corresponding pixel, so that it is not needed to apply additional power to the source driver in this circumstance. Thus, the power consumption can be reduced.

To be noted, the design of the memory circuit 22 may be various. As shown in FIG. 3B, the memory circuit 22*a* is constructed by, for example but not limited to, two inverters, and each inverter includes a p-type thin film transistor 224 and an n-type thin film transistor 225. It is noted that the inverter has a certain driving ability, so that the driving circuit 23 can be integrated with the inverter of the consequent memory circuit 22*a*.

Figure 4A:
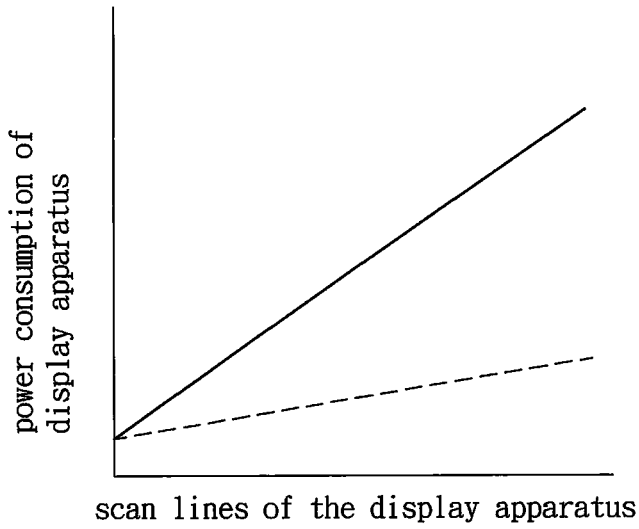
FIG. 4A (PRIOR ART)
FIG. 4A is a graphic diagram showing the curve representing the power consumption of the display apparatus without the memory.
Figure 4B:
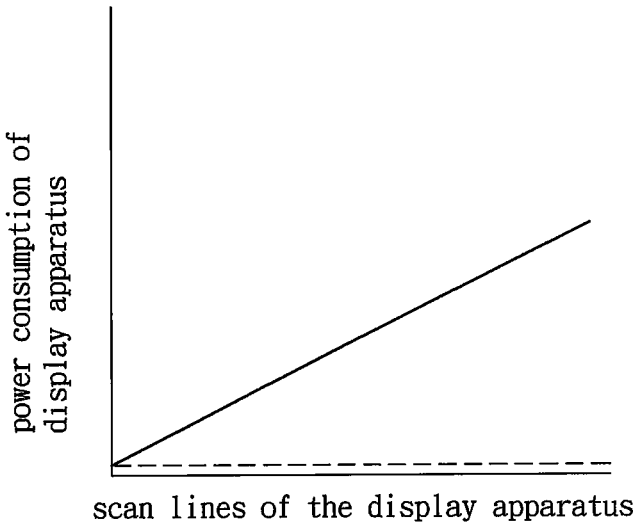
FIG. 4B is a graphic diagram showing the curve representing the power consumption of the display apparatus with the memory cell of the present embodiment.

FIG. 4A is a graphic diagram showing the curve representing the power consumption of the display apparatus without the memory circuit, and FIG. 4B is a graphic diagram showing the curve representing the power consumption of the display apparatus 2 with the memory circuit as shown in FIG. 3A. In FIGS. 4A and 4B, the X-axis represents the scan lines of the display apparatus, and the Y-axis represents the power consumption. Further, the solid line represents the total power consumption of the light emitting unit, and the dotted line represents the power consumption of the driver IC.

With reference to FIG. 4A, the source driver of the prior art must repeatedly write image data into pixels. When expanding scan lines of the display apparatus 2, the power consumption of source driver is increased because the source driver needs to send more image data to the pixels at the different scan lines. In addition, when only one part of the display apparatus shows image or the display apparatus dims, the source driver still don't stop, and the source driver still accesses memory frequently. Therefore, the power of the source driver becomes dominant among the total power consumption of the display apparatus 2.

On the contrary to FIG. 4A, as shown in FIG. 4B, because pixel 20 has memory circuit 22 to maintain image data, the source drive 42 does not need to repeatedly provide image data to the pixel 20. The source driver 42 may stop to provide image data to the pixel 20, and the power consumption does not raise when expanding scan lines of the display apparatus 2.

With reference to FIGS. 4A and 4B, in the display apparatus 2 of this embodiment, the power consumption of the driver IC is not increased as the dimension of the display apparatus 2 increases, and the power consumption of the overall display apparatus is lower than that of the conventional one.

In this embodiment, the memory circuit 22 is configured to store the image data, so that it is not necessary to apply additional power to the source driver for storing the image data into the pixels. Therefore, the power consumption of the display apparatus 2 can be further decreased.

Figure 5:
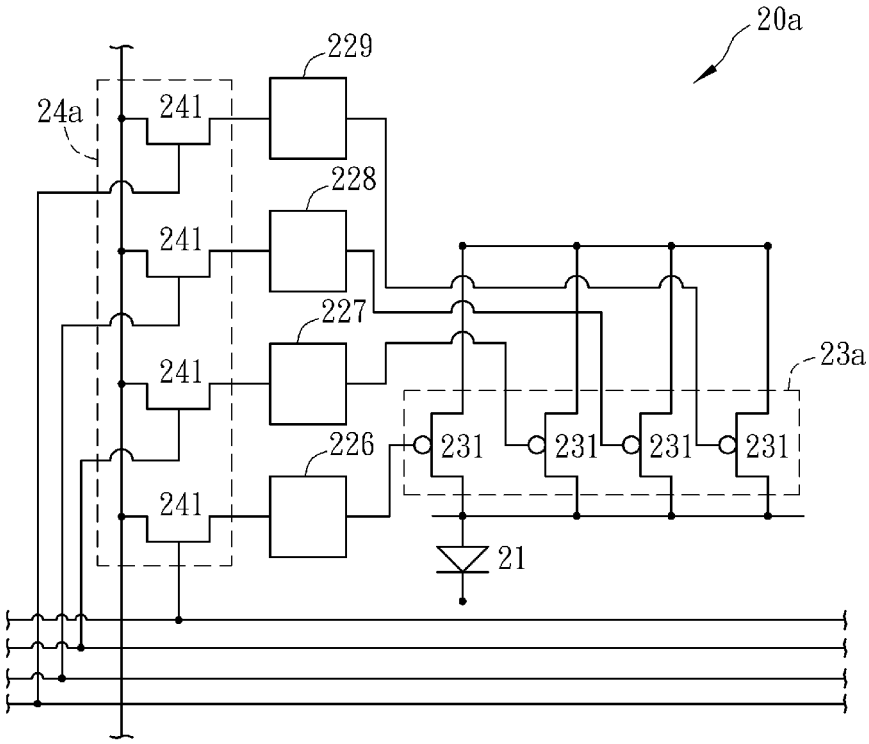
FIG. 5 is a schematic diagram showing different circuits of the pixel in the display apparatus according to the embodiment of the present invention.

However, the memory circuit 22 or 22*a* of FIG. 3A or 3B can store the data of only one bit. In order to increase the capacity for storing data, as shown in FIG. 5, each pixel 20*a* may include a plurality of memory circuits 226~229, the driving circuit 23*a* may include a plurality of transistors 231, and the switch circuit 24*a* may include a plurality of transistors 241. The transistors 231 as well as the transistors 241 are electrically connected with the corresponding memory circuits 226~229, respectively. Accordingly, the light emitting unit 21 of each pixel 20*a* can generate the color of various gray levels.

In this embodiment, the memory circuits 226~229 can represent different bits, respectively. For example, the memory circuits 226 to 229 represent four bits from left to right. The transistors 231 can be designed to have different driving abilities. For example, the transistor 231 corresponding to the left bit may have more powerful driving ability, wherein the driving ability of the transistor 231 relates to the equivalent resistance of the transistor 231.

Figure 6:
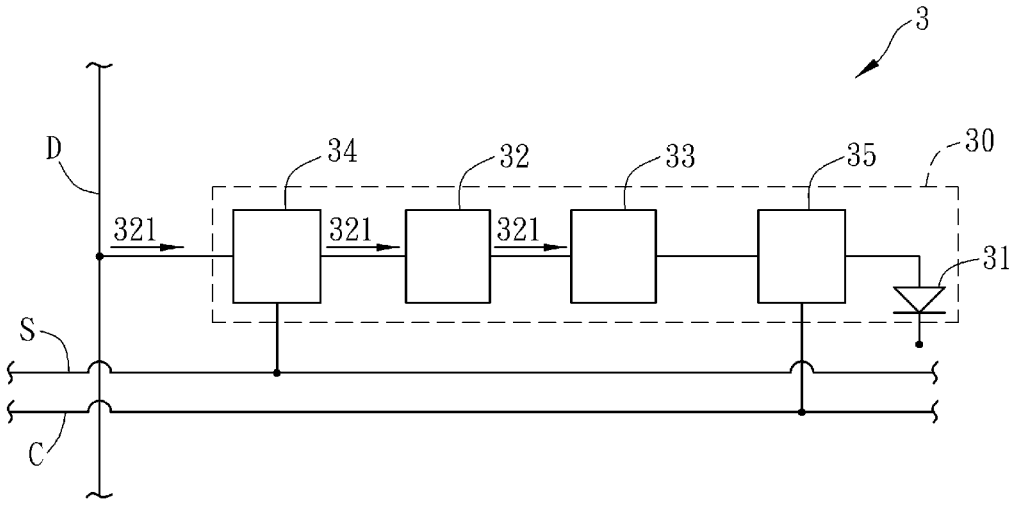
FIG. 6 is a block diagram showing the circuit of a display apparatus according to another embodiment of the present invention.

FIG. 6 is a block diagram showing the circuit of a display apparatus 3 according to another embodiment of the present invention. The display apparatus 3 includes a plurality of scan lines S, data lines D, mode control lines C, power lines (not shown in the figure) and pixels 30. Each pixel 30 includes a light emitting unit 31, a memory circuit 32, a driving circuit 33 and a mode switching circuit 35.

The memory circuit 32 stores an image data 321, and the driving circuit 33 is electrically connected with the light emitting unit 31 and the memory circuit 32 for driving the light emitting unit 31 according to the image data 321.

The arrangement and variation of the pixels 30 are similar to those of the pixels 20 of the previous embodiment, and the type and variation of the light emitting unit 31 are also similar to those of the light emitting unit 21 of the previous embodiment, so the detailed descriptions thereof will be omitted.

The data lines D are arranged perpendicular to the scan lines S, and the data lines D and the scan lines S are respectively connected with the pixels 30. The mode control lines C are arranged parallel to the scan lines S.

In this embodiment, the memory circuit 32 can be the memory circuit as described in the previous embodiment or other volatile or non-volatile memory circuit. Moreover, the memory circuit 32 is a discrete component for storing digital values. Alternatively, the memory circuit 32 can also be a capacitor that can store data in digital way, and the capacitor can present the stored data in digital mode or analog mode.

The mode switching circuit 35 is electrically connected with the memory circuit 32 and is controlled by the mode control line C for enabling the pixel 30 to operate in a MIP mode. The mode switching circuit 35 is further electrically connected with the memory circuit 32 and the driving circuit 33 for controlling the memory circuit 32 to presents the stored data in digital mode or analog mode, such that the driving circuit 33 drives the light emitting unit 31 according to the image data 321 of the memory circuit 32.

Figure 7:
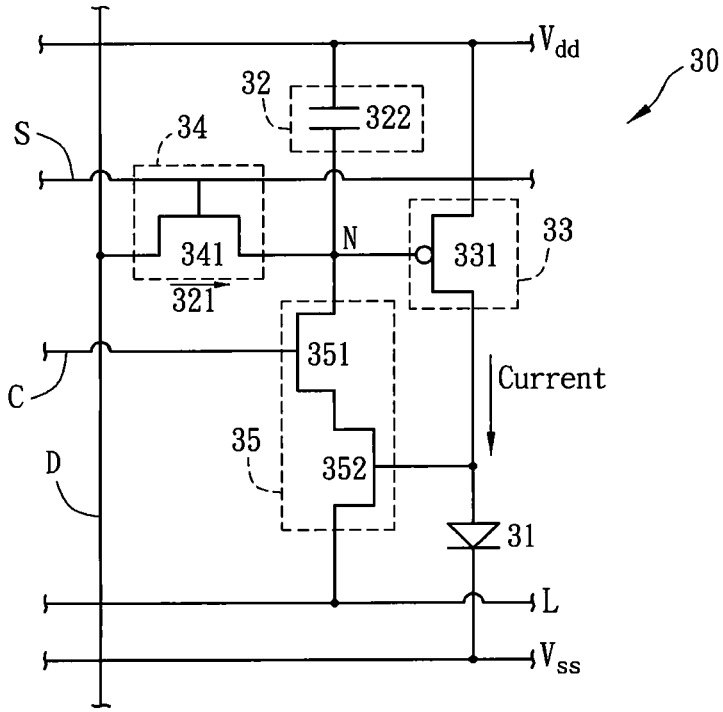
FIG. 7 is a schematic diagram showing the circuit of each pixel in the display apparatus of FIG. 6.

The detail and operation of the pixel 30 in this embodiment will be described hereinafter with reference FIGS. 7-11. FIG. 7 is a schematic diagram showing the circuit of each pixel in the display apparatus 3 shown in FIG. 6. To be noted, in order to make the following description more comprehensive, FIG. 7 shows the circuit of only one pixel, and this is not to limit the scope of the present invention. In addition, the memory circuit 32 includes, for example but not limited to, a capacitor 322, and the mode switching circuit 35 includes, for example but not limited to, an enabling switch 351 and a feedback switch 352.

Referring to FIG. 7, the enabling switch 351 is electrically connected with the driving circuit 33 and the memory circuit 32 for controlling the driving circuit 33 to drive the light emitting unit 31 according to the image data of the memory circuit 32 in a normal mode or a MIP mode. The feedback switch 352 is electrically connected with the enabling switch 351 and the light emitting unit 31. The light emitting unit 31 has a cathode and an anode, and the cathode of the light emitting unit 31 is electrically connected with the gate of the feedback switch 352 and the drain of the transistor 331 of the driving circuit 33. The anode of the light emitting unit 31 is electrically connected with a power line (power source Vss).

The transistor 331 of the driving circuit 33 is a p-type thin film transistor. The source of the transistor 331 is connected to a power line (power source Vdd), which extends along the corresponding rows of pixels 30, and the gate of the transistor 331 is electrically connected to one end of the capacitor 322, the drain of the transistor 341, and the drain of the enabling switch 351. In this case, the other end of the capacitor 322 is connected to the power line (power source Vdd).

The transistor 341 is an n-type thin film transistor. The source of the transistor 341 is electrically connected with the corresponding data line D, and the gate of the transistor 341 is electrically connected with the scan line S, which extends along the corresponding rows of the pixels 30.

The enabling switch 351 is an n-type thin film transistor. The gate of the enabling switch 351 is electrically connected with the mode control line C, and the mode control line C extends along the corresponding rows of the pixels 30. The drain of the enabling switch 351 is electrically connected with the drain of the feedback switch 352.

The feedback switch 352 is an n-type thin film transistor. The source of the feedback switch 352 is electrically connected with a bias line L, which extends along the corresponding rows of the pixels 30. For example, the bias line L is a low voltage line.

If the enabling switch 351 is turned off, the image data 321 stored in the capacitor 322 is read by an analog method, so that the voltage level of the image data 321 can control the current flowing through the transistor 331. Otherwise, if the enabling switch 351 is turned on, the image data 321 stored in the capacitor 322 is read by a digital method, so that the MIP mode, which is a low power-consumption mode, can be performed.

Figure 8:
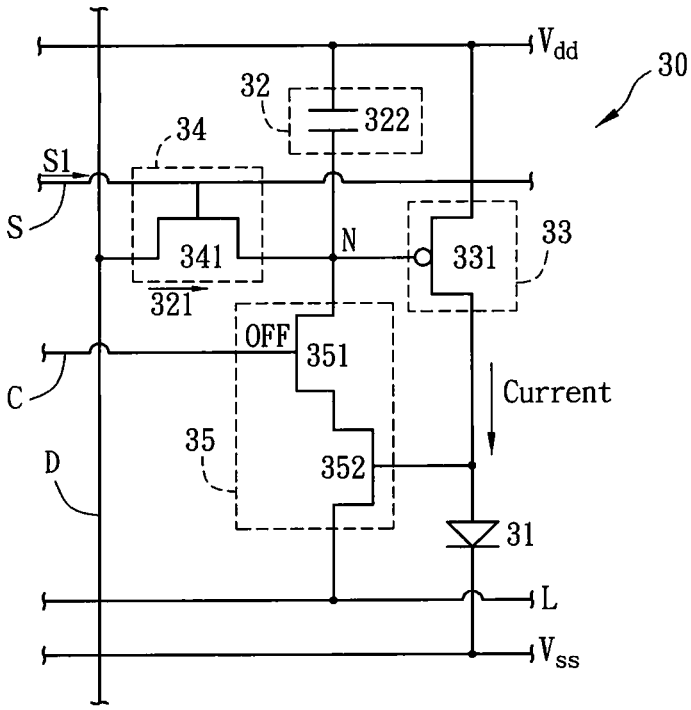
FIGS. 8-11 are schematic diagrams showing the operation of the circuit of FIG. 7.

With reference to FIG. 8, in the normal mode, the memory circuit 32 is periodically written with the image data 321. The memory circuit 32 presents the stored data in analog mode, and the driving circuit 33 drives the light emitting unit 31 according to the image data 321.

When the enabling switch 351 is turned off, the pixels 30 operate in a normal mode. The switch circuit 34 controls the memory circuit 32 to be written with the image data 321 periodically. Within a frame time, the scan line S outputs a scan signal S1 to turn on the transistor 341, so that the image data 321 can be inputted into the capacitor 322 through the data line D and the transistor 341. After the pixel 30 has been scanned by the scan line S, the transistor 341 is turned off and the voltage level of the capacitor 322 controls the current flowing through the transistor 331. The current flowing through the transistor 331 can drive the light emitting unit 31 to emit light to achieve the desired brightness.

Figure 9:
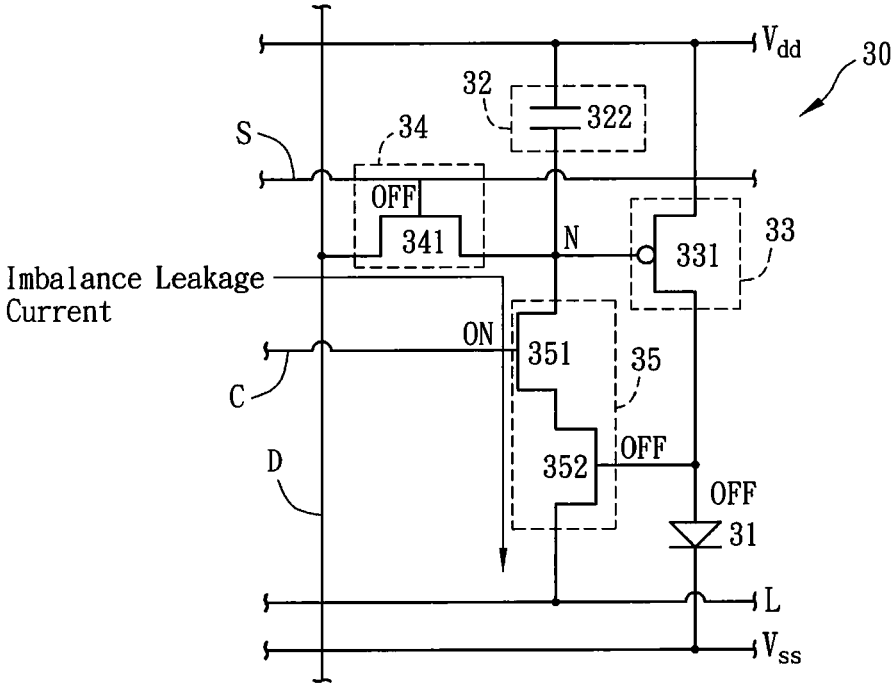
Figure 10:
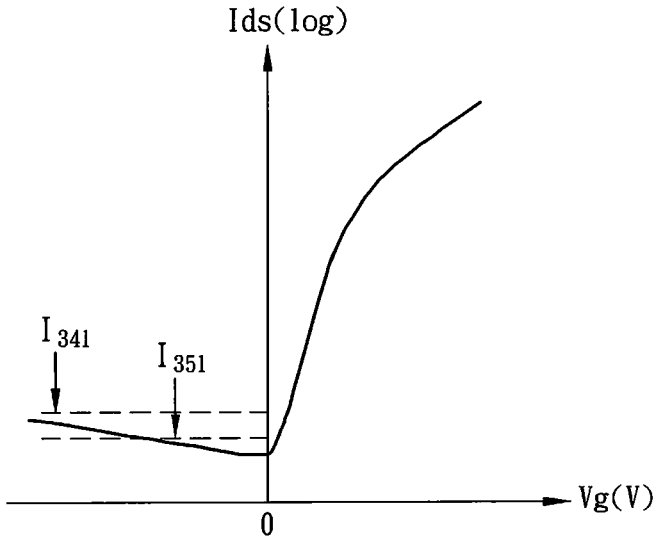

Referring to FIGS. 9-10, when the enabling switch 351 is turned on, the pixels 30 operate in the MIP mode. In this case, the scan line S does not output the scan signal, so that the transistor 341 is turned off.

In the MIP mode, the image data 321 stored in the memory circuit 32 can be hold by an imbalance leakage current. For example, the imbalance leakage current occurs because leakage current of the switch circuit 34 is larger than that of the mode switching circuit 35. As shown in FIG. 10, since the leakage current of the transistor 341 and the feedback switch 352 depends on their gate voltages, the leakage current of these transistors can be efficiently controlled when the gate voltages of the transistor 341, the transistors of the enable switch 351 and the transistors of the feedback switch 352 are well controlled. Thus, the leakage current of the transistor 341 can be larger than that of the transistors of the enable switch 351 and the feedback switch 352, such that the leakage current from the memory circuit 32 can be compensated and the stored image data can be hold.

The memory circuit 32 stores the image data hold by the imbalance leakage current, and it presents the stored data in digital mode. The driving circuit 33 drives the light emitting unit 31 according to the image data.

If the node N is in a high voltage level, the driving circuit 33 is turned off and the light emitting unit 31 does not emit light. Thus, the transistor of the feedback switch 352 is turned off, and the feedback path is disabled. The leakage current of the switch circuit 34 is larger than that of the enabling switch 351 and the feedback switch 352 to hold the image data. In this case, the node N is kept in the high voltage level so as to make the driving circuit 33 in a turn-off state. The light emitting unit 31 still does not emit light.

In order to remain the electric charges in the capacitor 322 without leaking through the transistor, the data line D can be kept in the high voltage level. Since the leakage current of the transistor 341 can be larger than that of the transistors of the enabling switch 351 and the feedback switch 352, consequently, the voltage of the node N may become the high voltage level or be kept in the high voltage level. This can disable the feedback path while the node N is in the high voltage level, so that the voltage can be maintained.

Figure 11:
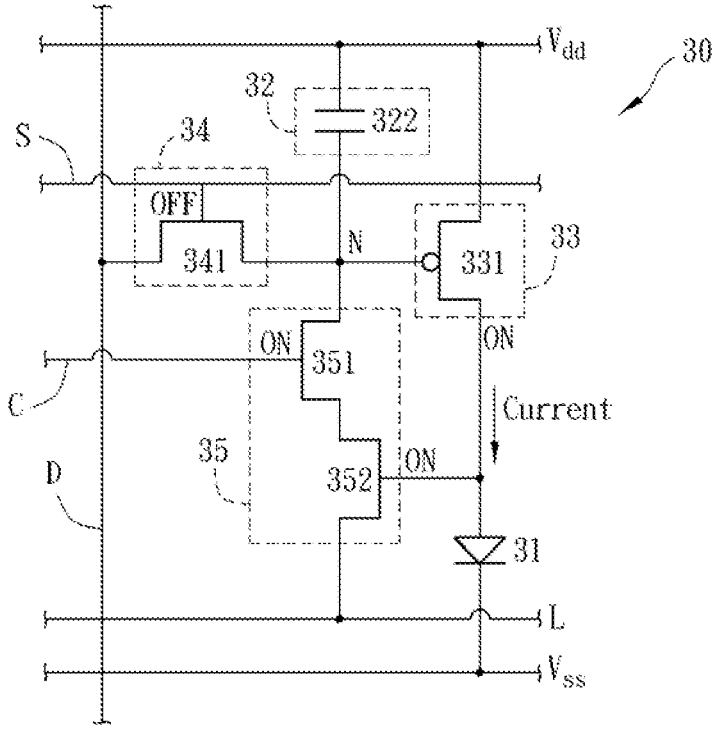

In addition, with reference to FIG. 11, in the MIP mode, if the node N is in a low voltage level, the transistor 331 is turned on so as to enable the current flowing through the driving circuit 33 to drive the light emitting unit 31. When the light emitting unit 31 emits light, the feedback switch 352 is turned on to connect the memory cell 32 with a bias line L through the enabling switch 351 and the feedback switch 352. The bias line L can be an additional wire (as shown in FIGS. 7-9 and 11) or a wire connected to the light emitting unit 31. In other example, the bias line L may be integrated with the wire Vss. In this case, the gate of the transistor of the feedback switch 352 is about the forward voltage drop by the light emitting unit 31, so that the transistor of the feedback 352 is turned on. Thus, the feedback path can be enabled, and the node N is still in the low voltage level. The light emitting unit 31 maintains emitting light.

In other words, the pixels 30 have two display modes: a first mode and a second mode.

The first mode is a normal mode. In this mode, the analog data are written into the capacitor 322 of the pixel 30 as usual, and the transistor 331 can control the current flowing through the light emitting unit according to the analog voltage level stored in the capacitor 322.

The second mode is a MIP mode. In this mode, the memory cell 32 of the pixel is isolated from the scan line, so that the data stored in the memory cell 32 can not be changed or rewritten. In the second mode, the gate driver does not output the scan signal to the pixel 30. The benefit of this driving method is maximized especially at the partial dimmed lit mode.

To sum up, in the display apparatus of the present invention, each pixel has a memory cell for storing the image data during a frame time. Accordingly, the image data can be remained in the memory cell of the pixel without continuously receiving the image data from the data line. Therefore, the memory of the source driver is unnecessary to continuously store the image data and output it to the corresponding pixel, so that it is not needed to apply additional power to the source driver in this circumstance. Thus, the power consumption can be reduced. To be noted, the benefit of this driving method is maximized especially at the partial dimmed lit mode.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A display apparatus comprising a plurality of pixels, a plurality of scan lines electrically connected with the pixels respectively and a plurality of data lines electrically connected with the pixels respectively and a plurality of data line electrically connected with the pixels respectively, each of the pixels comprising:

a light emitting unit;

a memory circuit for storing an image data;

a driving circuit electrically connected with the light emitting unit and the memory circuit, and driving the light emitting unit according to the image data;

a mode switching circuit electrically connected with the memory circuit and a mode control line for controlling the driving circuit to drive the light emitting unit according to the image data stored in the memory circuit in a normal mode or a Memory-In-Pixel (MIP) mode, wherein the mode switching circuit comprises:

an enabling switch electrically connected with the driving circuit and the memory circuit for controlling the driving circuit to drive the light emitting unit according to the image data stored in the memory circuit in the normal mode or the MIP mode;

and a feedback switch electrically connected with the enabling switch and the light emitting unit, wherein when the light emitting unit emits light, the feedback switch is turned on to connect the enabling switch and a bias line; and a switch circuit electrically connected with the memory circuit, one of the scan lines, and one of the data lines, wherein the scan line outputs a scan signal to turn on the switch circuit, so that the image data is written into the memory circuit through the data line in the normal mode, wherein an imbalance leakage current of the switch circuit is larger than that of the mode switching circuit such that the image data stored in the memory circuit is hold by the imbalance leakage currents.

2. The display apparatus according to claim 1, wherein the light emitting unit is an organic light-emitting diode (OLED).

3. The display apparatus according to claim 1, wherein the memory circuit is a static random access memory (SRAM) or a capacitor capable of storing data in digital way.

4. The display apparatus according to claim 1, wherein in the MIP mode, a high voltage level is applied to the source lines and no scan signal is applied to the gate lines.

5. The image display system of claim 1, further comprising:

a display apparatus, the display apparatus comprising the organic electroluminescence device.

* * * * *